US006217466B1

(12) United States Patent
Yimoyines

(10) Patent No.: US 6,217,466 B1
(45) **Date of Patent: *Apr. 17, 2001**

(54) RACQUET AND METHOD OF STRINGING A RACQUET

(75) Inventor: Dean Yimoyines, Middlebury, CT (US)

(73) Assignee: Linda C. Yimoyines, Middlebury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/433,438

(22) Filed: Nov. 4, 1999

Related U.S. Application Data

(63) Continuation of application No. 09/126,195, filed on Jul. 30, 1998.

(51) Int. Cl.[7] ..... A63B 51/00; A63B 49/00
(52) U.S. Cl. ..... 473/539; 473/540
(58) Field of Search ..... 473/539, 540, 473/FOR 178

(56) References Cited

U.S. PATENT DOCUMENTS

| | | | | |
|---|---|---|---|---|
| 4,138,109 | * | 2/1979 | Nobbs | 473/539 |
| 4,140,316 | * | 2/1979 | Coupar | 473/540 |
| 4,204,680 | | 5/1980 | Blackburne | 273/73 |
| 4,204,681 | * | 5/1980 | Hall, Jr. et al. | 473/539 |
| 4,693,474 | * | 9/1987 | Glaessgen et al. | 473/519 |
| 4,747,598 | | 5/1988 | Curtis | 273/73 |
| 5,029,859 | * | 7/1991 | Davis | 473/539 |
| 5,092,593 | | 3/1992 | Williams et al. | 273/73 |
| 5,667,216 | * | 9/1997 | Gunn | 473/540 |

FOREIGN PATENT DOCUMENTS

| | | | | |
|---|---|---|---|---|
| 3004646 | * | 8/1981 | (DE) | 473/FOR 178 |
| 1278474 | * | 6/1972 | (GB) | 473/FOR 178 |

* cited by examiner

*Primary Examiner*—Raleigh W. Chiu
(74) *Attorney, Agent, or Firm*—St. Onge Steward Johnston & Reens LLC

(57) ABSTRACT

The invention provides an improved racquet and a method of stringing a racquet wherein the racquet includes grommets that are divided into visually differentiated groups in order to make stringing the racquet quicker and easier. According to one embodiment, the grommets are visually differentiated by color, while in another embodiment, the grommets are visually differentiated by shape.

5 Claims, 4 Drawing Sheets

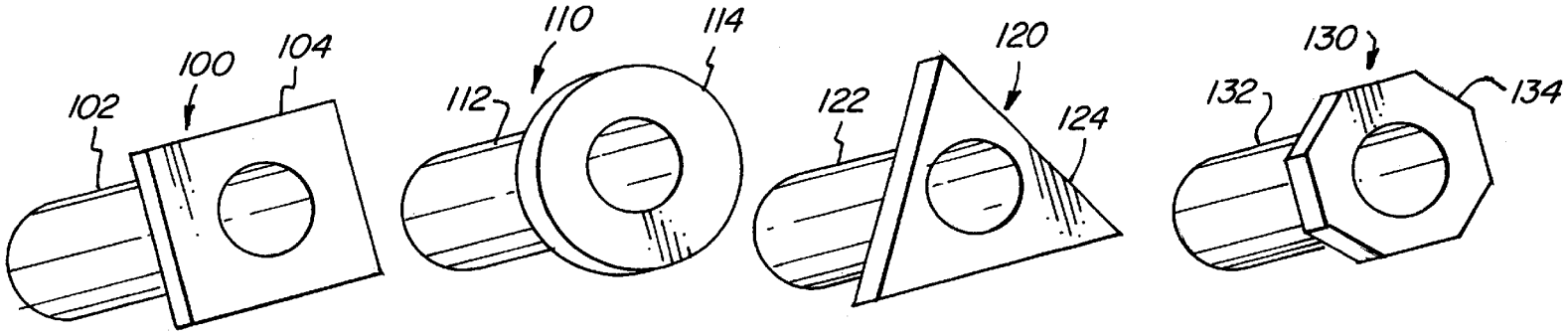
FIG. 5a
FIG. 5b
FIG. 5c
FIG. 5d
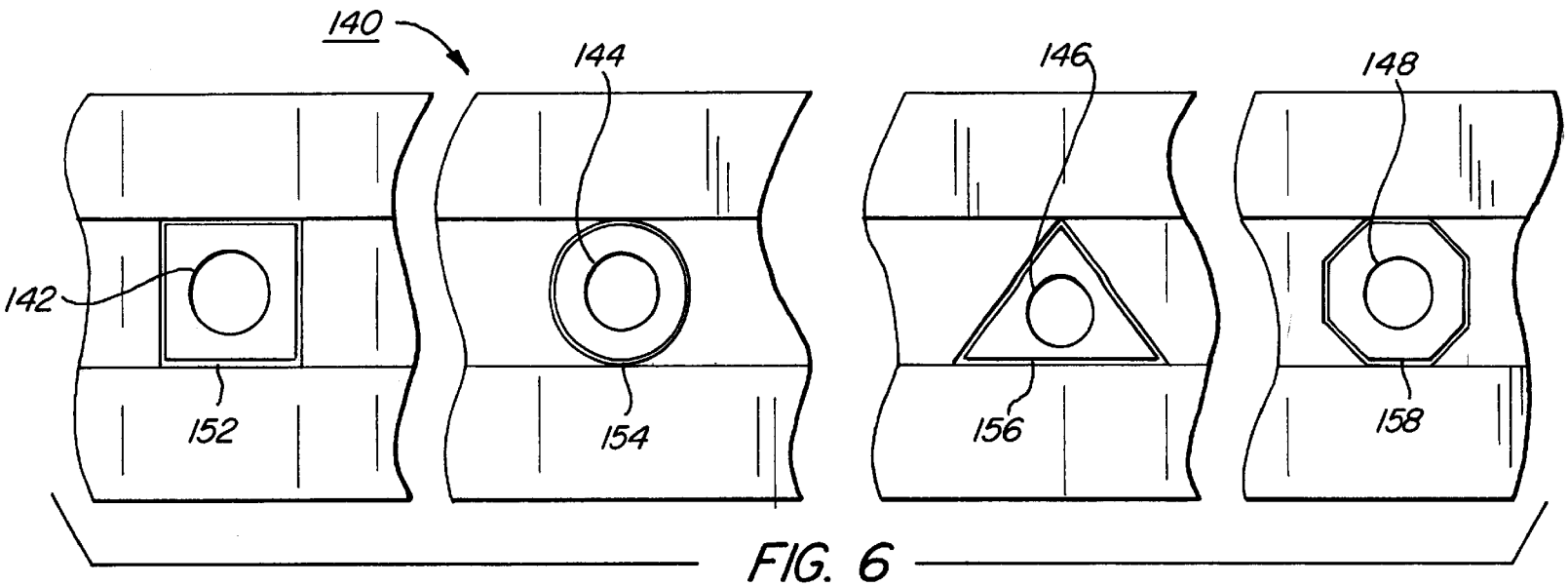
FIG. 6

RACQUET AND METHOD OF STRINGING A RACQUET

CLAIM OF PRIORITY

This is a continuation of copending U.S. application Ser. No. 09/126,195, filed Jul. 30, 1998.

FIELD OF THE INVENTION

The present invention relates to racquet stringing. More particularly, the present invention relates to a racquet and a method of stringing a racquet

BACKGROUND OF THE INVENTION

As is known, racquets, such as tennis racquets for example, include a frame having a handle extending from a ring-shaped head, and at least one resilient string strung across the head. Stringing a racquet, includes a number of steps where a stringer can make a mistake and incorrectly string the racquet. For example, the stringer normally has to identify center holes at a top and a bottom of the head of the racquet as starting points for stringing the racquet. Thereafter, as the stringing continues, vertical stringing holes and horizontal stringing holes must be differentiated. Initially, this is not very difficult. However, as the stringing moves away from the center holes, vertical holes eventually alternate with horizontal holes, thereby making the differentiating more difficult.

What is needed, therefore, is a racquet and a method of stringing a racquet wherein starting holes, vertical and horizontal holes, and tie-off holes of the racquet are clearly differentiated in order to make stringing the racquet foolproof.

SUMMARY OF THE INVENTION

Accordingly, one object of the present invention is to provide an improved racquet and method of stringing a racquet wherein stringing the racquet is simplified.

Another object of the present invention is to provide an improved racquet and method of stringing a racquet wherein vertical and horizontal string holes of the racquet are clearly differentiated.

An additional object of the present invention is to provide an improved racquet and method of stringing a racquet wherein starting string holes are differentiated from other string holes of the racquet.

A further object of the present invention is to provide an improved racquet and method of stringing a racquet wherein tie-off string holes of the racquet are differentiated from other string holes of the racquet.

The present invention meets these and other objects by providing a racquet including a head having a multiplicity of spaced-apart string holes, and grommets fitted in the string holes. The grommets are divided into visually differentiated groups.

According to one aspect of the present invention, the groups of grommets are visually differentiated by color.

According to another aspect of the present invention, the groups of grommets are visually differentiated by shape.

The present invention also provides a racquet head guard including a head guard for wrapping around an outer surface of a racquet head, and grommets unitarily formed with the head guard for fitting within string holes of the racquet head. The grommets are divided into visually differentiated groups.

The present invention further provides a method of stringing a racquet including a head having a multiplicity of string holes divided into starter, vertical, horizontal, and tying string holes. The method includes fitting a first group of grommets into the starter string holes, fitting a second group of grommets into the vertical string holes, fitting a third group of grommets into the horizontal string holes, and fitting a fourth group of grommets into the vertical string holes. Each of the groups of grommets is visually differentiated from one another. A string is then first passed through the string holes fitted with the first group of grommets, then the string holes fitted with the second group of grommets, and then the string holes fitted with the third group of grommets. The ends of the string are finally tied off in at least one of the string holes fitted with the fourth group of grommets.

The invention and its particular features and advantages will become more apparent from the following detailed description considered with reference to the accompanying drawings.

BRIEF DESCRIPTION OF THE DRAWINGS

FIGS. 5*a*–5*d* are top isometric views of additional grommets according to the present invention; and FIG. 6 is a top plan view of portions of another head guard according to the present invention having unitary grommets

DETAILED DESCRIPTION OF THE INVENTION

Figure 1:
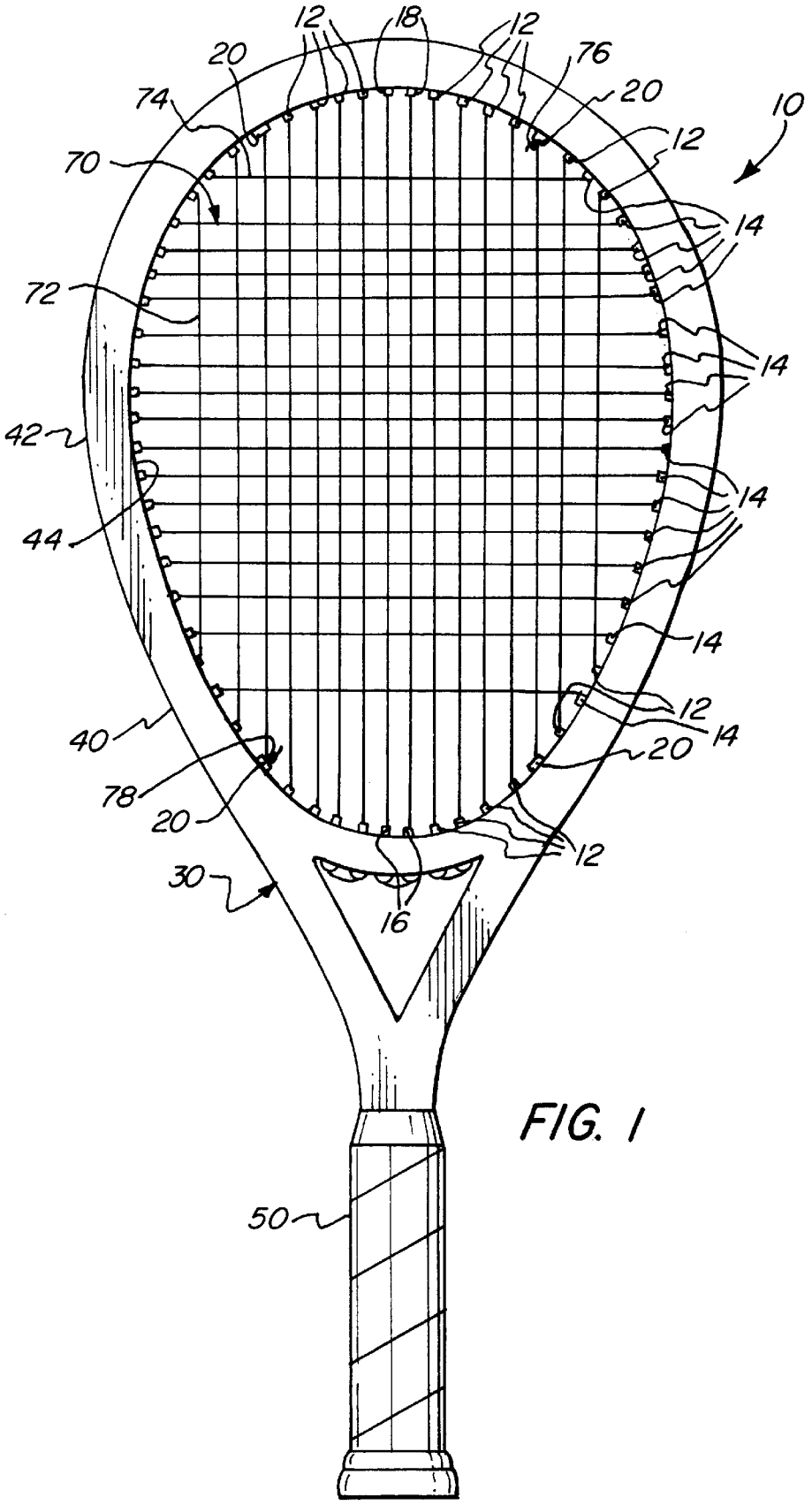
FIG. 1 is a front elevation view of a racquet according to the present invention.
Figure 2:
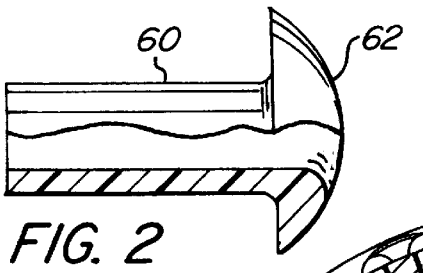
FIG. 2 is a side elevation view, partially in section of a grommet of the racquet of FIG. 1.
Figure 3:
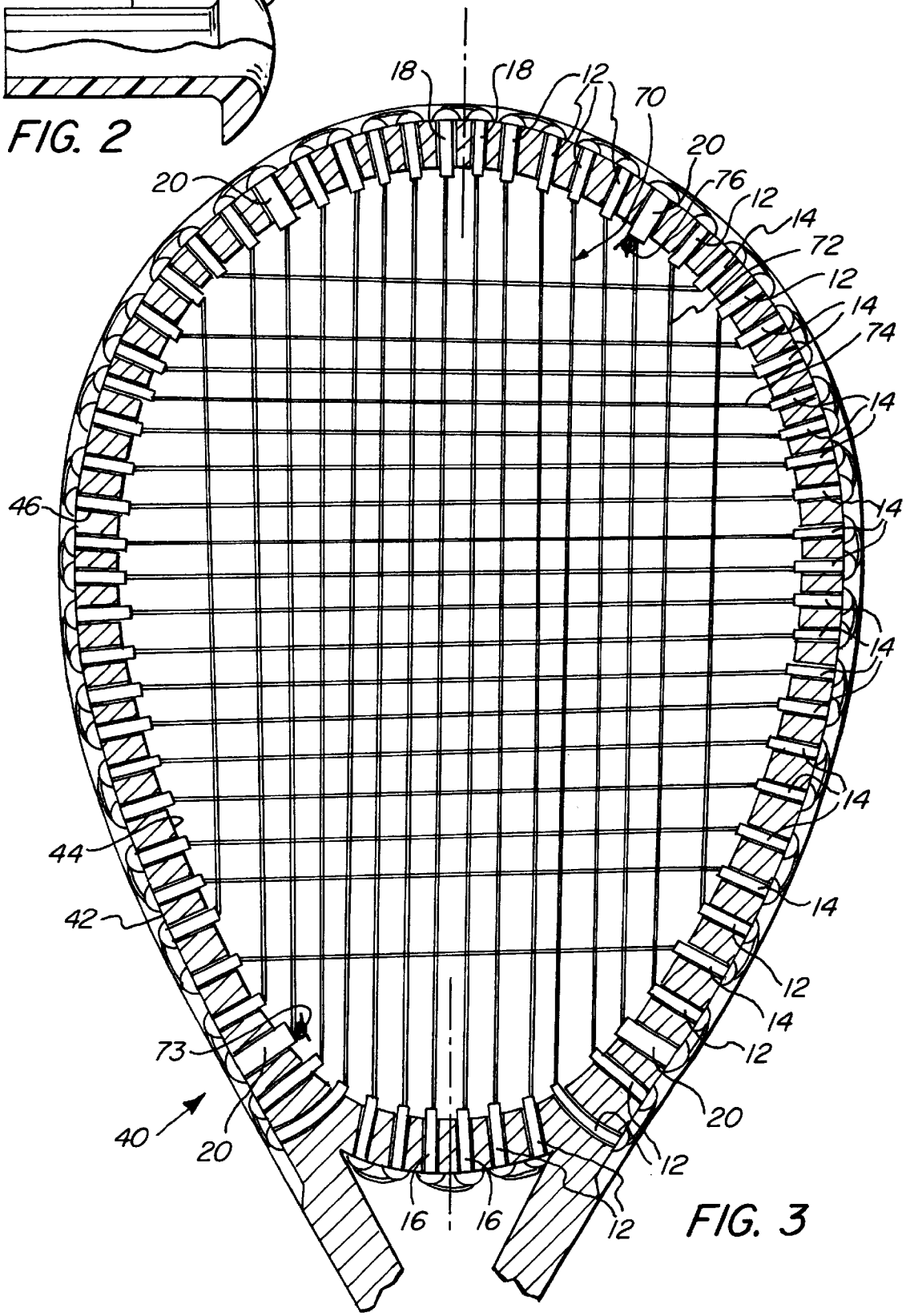
FIG. 3 is an enlarged, front elevation view, partially in section, of a head of the racquet of FIG. 1.

Referring first to FIGS. 1 through 3, the present invention provides an improved racquet 10 and a method of stringing a racquet. More particularly, the present invention provides a racquet 10 having grommets 12, 14, 16, 18, 20 that are divided into visually differentiated groups in order to make stringing the racquet quicker and easier.

The racquet 10 includes a body 30 having a head 40 and a handle 50 extending from the head. The body 30 can be made from any suitable strong and lightweight material, such as aluminum, reinforced plastic, and/or graphite for example. The head 40 of the racquet 10 includes an outer side surface 42, an inner side surface 44 and a multiplicity of spaced-apart string holes 46 extending between the inner and outer side surfaces.

The grommets 12, 14, 16, 18, 20 are fitted in the string holes 46. As shown in FIG. 2, the grommets each include a sleeve 60 extending from an annular head 62. The sleeve 60 fits within the string hole 46, while the head 62 prevents the grommet from passing through the string hole.

The racquet 10 additionally includes at least one string 70 strung through the grommets 12, 14, 16, 18, 20 in the string holes 46 of the head 40 of the racquet 10. As shown, the string 70 is strung such that it forms a plurality of vertical segments 72 and a plurality of horizontal segments 74, which are meshed together.

The improvement provided by the present invention comprises visually differentiating the grommets 12 that receive the vertical segments 72 of the string 70 from the grommets 14 that receive the horizontal segments 74 of the string. Preferably, the vertical grommets 12 are provided in a first color, while the horizontal grommets 14 are provided in a second color. For example, the vertical grommets can be provided in a first color comprising blue, while the horizontal grommets can be provided in a second color comprising red.

Four grommets 16, 18 are visually differentiated from both the vertical grommets 12 and the horizontal grommets 14. These four grommets comprise center grommets 16, 18. In the embodiment shown, the center grommets 16, 18 are positioned at a top and a bottom of the head 40 of the racquet 10, one on either side of a vertical centerline 48 of the head. Two of the four center grommets are further visually differentiated from the two remaining center grommets 18, and are starter center grommets 16. In the embodiment shown, the starter center grommets 16 are positioned at the bottom of the head 40. Preferably, all four of the center grommets 16, 18 are provided in a third color, while the two starter center grommets 16 are further provided with speckling or stripes, for example.

Four grommets 20 are visually differentiated from the center grommets 16, 18, the vertical grommets 12 and the horizontal grommets 14 of the racquet 10. These four grommets 20 comprise tying grommets and are normally larger than the other grommets. Preferably, the tying grommets 20 are provided in a fourth color, such as white for example.

A method of stringing the racquet 10 is also provided by the present invention. First, a first end 76 of the string 70 is passed through one of the starter center grommets 16 and up through the center grommet 18 at the top of the head 40 on the same side of the centerline 48 of the head. The first end 76 of the string is then progressively strung through the vertical grommets 12 away from the centerline to form the vertical segments 72 of the string. Then, a second end 78 of the string 70 is passed through the other of the starter center grommets 16 and up through the center grommet 18 at the top of the head 40 on the same side of the centerline 48 of the head. The second end 78 of the string is then progressively strung through the vertical grommets 12 away from the centerline to form additional vertical segments 72 of the string. Thereafter, one or both of the first and second ends 76, 78 of the string 70 are progressively strung through the horizontal grommets 14 to form the horizontal segments 74 of the string. Finally, both ends 76, 78 of the string are tied-off through two of the four tying grommets 20, to secure the string in position on the head. As can be inferred, visually differentiating the center grommets 16, 18, the horizontal and vertical grommets 12, 14, and the tying grommets 20 from one another makes stringing the racquet 10 quicker, easier and foolproof.

Figure 4:
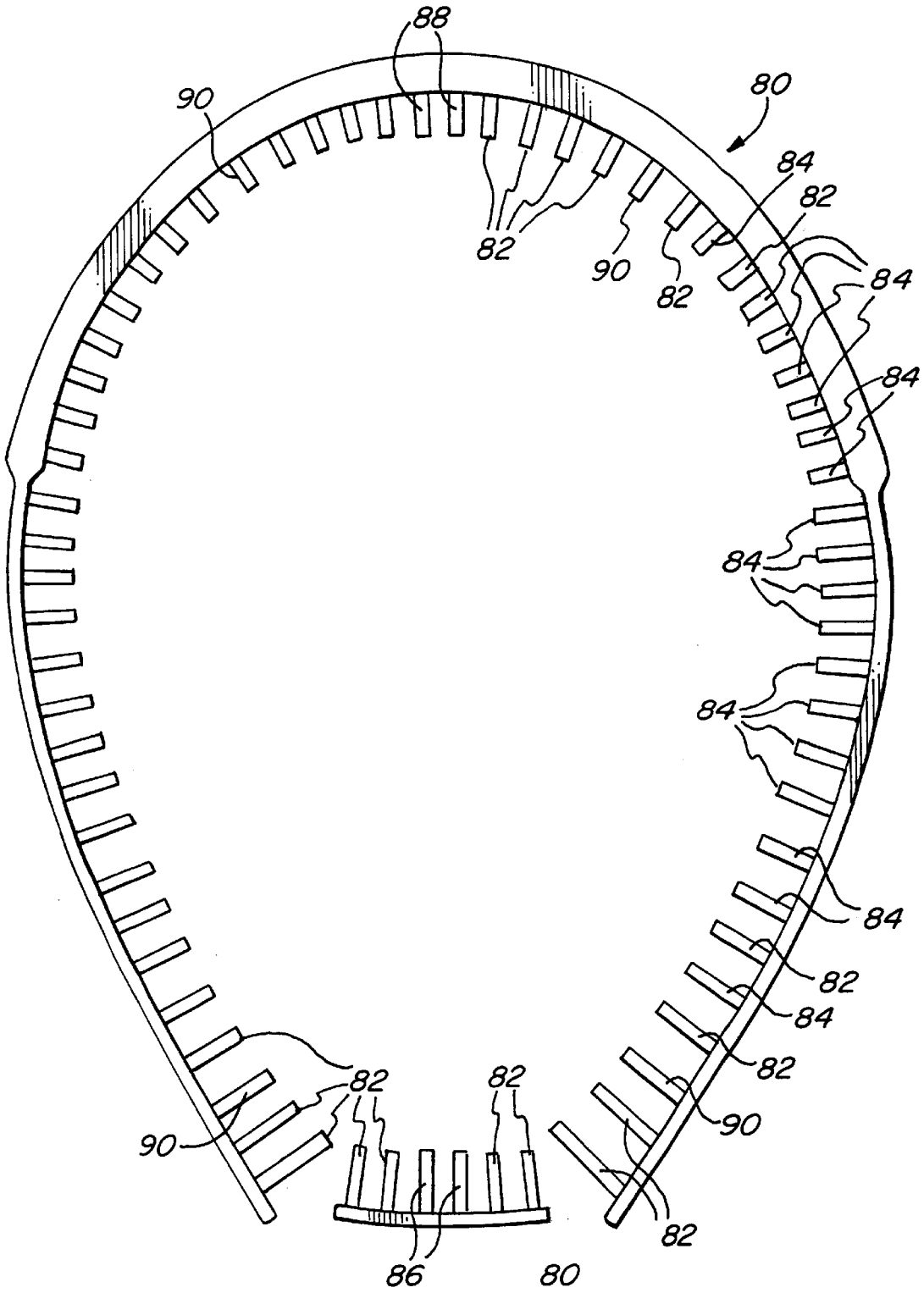
FIG. 4 is a front elevational view of a head guard according to the present invention having unitary grommets.

Referring to FIG. 4, a two piece racquet head guard 80 according to the present invention is shown (guard 80 may also be a four-piece guard). The head guard includes center grommets 86, 88, vertical grommets 82, horizontal grommets 84, and tying grommets 90. All the grommets are unitarily formed with the head guard. As is known, the grommets fit through the string holes 46 of a racquet head 40, while the head guard 80 wraps around the outer side surface 42 of the top portion of the head to protect the head from incidental contact with other objects, such as a playing surface for example. The improvement provided by the present invention comprises visually differentiating the center grommets 86, 88, vertical grommets 82, horizontal grommets 84, and tying grommets 90 from each other. Preferably, the vertical grommets are provided in a first color, while the horizontal grommets are provided in a second color, the center grommets are provided in a third color and the tying grommets are provided in a fourth color. Furthermore, two 86 of the four center grommets are further visually differentiated from the other two center grommets 88, and are starter center grommets. Preferably, the two starter center grommets 86 are provided with speckling or stripes, for example.

Referring now to FIGS. 5*a*–5*d*, additional grommets 100, 110, 120, 130 according to the present invention are shown. Each of the grommets 100, 110, 120, 130 includes a sleeve 102, 112, 122, 132 extending from a generally annular head 104, 114, 124, 134, respectively. The grommets 100, 110, 120, 130 of FIGS. 5*a*–5*d* are visually differentiated from one another, and could be used, respectively, as center grommets, vertical grommets, horizontal grommets, and tying grommets. The grommets 100, 110, 120, 130 are visually differentiated by being provided with heads 104, 114, 124, 134 having a first, second, third and fourth shape, respectively. In particular, the grommet 100 of FIG. 5*a*, is provided with a head 104 having a first shape comprising a square, while the grommet 110 of FIG. 5*b* is provided with a head 114 having a second shape comprising a circle, the grommet 120 of FIG. 5*c* is provided with a head 124 having a third shape comprising a triangle, and the grommet 130 of FIG. 5*d* is provided with a head 134 having a fourth shape comprising a hexagon. As can be again understood, visually differentiating the center grommets, the horizontal and the vertical grommets, and the tying grommets from one another in this way makes stringing the racquet quicker, easier and foolproof.

Referring to FIG. 6, another racquet head guard 140 according to the present invention is shown. The head guard 140 includes center grommets 142, vertical grommets 144, horizontal grommets 146, and tying grommets 148 unitarily formed with the head guard. In addition, the center grommets, vertical grommets, horizontal grommets, and tying grommets are visually differentiated from one another. This is done by providing indentations of different shapes in the head guard 140 over the grommets. For example, the center grommets 142 are provided with a corresponding indentation 152 having a first shape comprising a square, while the vertical grommets 144 are provided with a corresponding indentation 154 having a second shape comprising a circle, the horizontal grommets 146 are provided with a corresponding indentation 156 having a third shape comprising a triangle, and the tying grommets 148 are provided with a corresponding indentation 158 having a fourth shape comprising a hexagon. As can be understood, visually differentiating the center grommets, the horizontal and the vertical grommets, and the tying grommets from one another in this way makes stringing the racquet quicker, easier and foolproof.

Although the invention has been described with reference to a particular arrangement of parts, features and the like, these are not intended to exhaust all possible arrangements or features, and indeed many other modifications and variations will be ascertainable to those of skill in the art. In particular, grommets for use with a racquet can be visually differentiated in many ways other than disclosed.

What I claim is:

1. A racquet comprising:

a head having a multiplicity of spaced-apart string holes for receiving at least one string, the string holes comprising starter string holes, tying string holes and string holes which are neither starter string holes nor tying string holes;

a first group of grommets fitted in the starter string holes;

a second group of grommets fitted in the tying string holes, the second group of grommets being visually differentiated from the first group of grommets; and, a third group of grommets fitted in the string holes which are neither starter string holes nor tying string holes, the third group of grommets being visually differentiated from the first group of grommets and the second group of grommets.

2. A racquet according to claim 1 wherein the string holes which are neither starter string holes nor tying string holes comprise vertical string holes and horizontal string holes.

3. A racquet according to claim 1 wherein the first, second and third groups of grommets are visually differentiated by color.

4. A racquet according to claim 1 wherein the first, second and third groups of grommets are visually differentiated by shape.

5. A method of preparing a racquet to be strung, the racquet including a head having starter string holes, tying string holes and holes which are neither starter string holes nor tying string holes, the method comprising:

fitting a first group of grommets into the starter string holes;

fitting a second group of grommets visually differentiated from the first group of grommets into the tying string holes; and fitting a third group of grommets visually differentiated from the first group of grommets and the second group of grommets into the holes which are neither starter string holes nor tying string holes.

* * * * *